United States Patent [19]

Kekish et al.

[11] 4,428,310

[45] Jan. 31, 1984

[54] PHOSPHATED ALUMINA AS SLAG MODIFIER

[75] Inventors: George T. Kekish, Naperville; Diep V. Xieu, Aurora, both of Ill.

[73] Assignee: Nalco Chemical Company, Oak Brook, Ill.

[21] Appl. No.: 401,740

[22] Filed: Jul. 26, 1982

[51] Int. Cl.[3] ..... F23B 7/00

[52] U.S. Cl. ..... 110/342; 110/344

[58] Field of Search ..... 110/342, 343, 344, 345; 44/4, 5

[56] References Cited

U.S. PATENT DOCUMENTS

| | | | |
|---|---|---|---|
| 3,002,855 | 10/1961 | Phillips et al. | 110/343 X |
| 4,190,421 | 2/1980 | Hwa | 110/343 X |
| 4,253,408 | 3/1981 | Kramer | 110/343 X |
| 4,372,227 | 2/1983 | Mahoney et al. | 110/343 X |
| 4,377,118 | 3/1983 | Sadowski | 110/343 |

FOREIGN PATENT DOCUMENTS

| | | | |
|---|---|---|---|
| 496692 | 12/1938 | United Kingdom | 110/343 |

*Primary Examiner*—Edward G. Favors

[57] ABSTRACT

A technique for raising slag fusion temperatures is provided whereby fouling deposits can be reduced. The technique involves mixing with slag or slag precursers phosphated alumina perferably in a liquid form for convenience in application.

25 Claims, No Drawings

PHOSPHATED ALUMINA AS SLAG MODIFIER

BACKGROUND OF THE INVENTION

1. Field of this Invention

This invention lies in the field of additives to increase the fusion temperature of slag derived from solid fuel.

2. Description of the Prior Art

The use of additives for the purpose of gaining some performance advantage in fuel combustion has been given much attention. The additives generally may be classified as (1) preflame additives (for improved storage and handling of fuel), (2) combustion additives (for improved combustion efficiency and reduction of pollutants and particulates), and (3) post-flame functioning additives (for particulate collection, fireside deposit control, and cold side corrosion reduction). In the present invention, the emphasis is on class (3) fuel additives, especially those which control the deposits of slag including in commercial-sized furnaces using coal and other solid fuels.

Slagging and fouling (sometimes termed fireside deposits) and corrosion problems are generally considered to be caused by the sulfur, alkali-metals, and chlorine in solid fuels such as coal. Fundamental research is still needed to understand the mechanisms involved.

Among known class (3) additives are magnesium based additives, such as magnesium oxide, metallic magnesium particles, and the like, which can be added to slag and slag precursers by spraying or injecting into a combustion chamber. Reduction in deposits in both oil and coal fired boilers has been reported.

Silica based additives reportedly reduce ash bonding and such additives are used mostly with residual fuel oil.

Antimony trioxide is reportedly an effective fuel additive in reducing deposits and corrosion, but antimony is a toxic substance.

Copper oxychloride is reported to have been successfully used in coal fired boilers to produce light, friable, easily removed deposits (in place of previously obtained heavy, glassy slag deposits).

Calcium based montmorillonite clay reportedly has been used as a combustion improver and slag preventative.

During combustion in a boiler furnace, the reactions which occur between the fuel impurities lead to the formation of deposits which adhere to boiler surfaces. Such deposits upset the normal operating conditions and produce problems by causing: (a) obstruction to gas flow, (b) interference with heat transfer (resulting from the insulative nature of such deposit), (c) damage to water tubes on the ash slopes particularly with bulky such deposits), (d) corrosive conditions producing serious loss of metal tubes. These deposit and associated corrosions force nonscheduled outages for cleaning (deslagging) and/or for replacing the failed tubes which can be costly.

Even though a lot of research and experimental work has been carried out on the problem of so-called external fouling in boilers, there still remains a large number of unsolved problems. The prior art method for reducing boiler fouling involving the use of fuel additives has been used with varying degrees of success. In oil fired boilers, additives help mainly to prevent corrosion on the cooler parts of the system, while in coal or bark fired boilers the emphasis has been on additives which reduce external fouling.

New and improved class (3) fuel and slag treatment additives are needed to minimize the slagging and the deposit producing (fouling) potentials of the combustion products of coal and other combustible organic solid fuels.

BRIEF SUMMARY OF THE INVENTION

More particularly, the present invention relates to a process for increasing the fusion temperature of a high silicon slag of the type derived from burning a solid fuel such as particularly bark, wood chips, or the like, the process involving compensating or admixing with such a slag or its precursers (including uncombusted fuel) a phosphated alumina. The invention further relates to the slag so produced.

Thus, a phosphated alumina can be admixed (a) directly with a slag itself, (b) with a solid fuel to the combusted, before the same is combusted, and/or (c) with a solid fuel which is in the actual process of being combusted (as in a furnace or combustion zone).

Typically, the quantity of the phosphated alumina so admixed ranges from about 0.1 to 5 weight percent (based upon the total amount of inorganic matter present or estimated to be present in a slag or slag precurser), though larger and smaller amounts of phosphated alumina can be employed without departing from the spirit and scope of this invention to achieve beneficial results of the types indicated. A presently preferred admixture range for the phosphated alumina extends from about 0.1 to 1.0 weight percent (same basis).

Thus, an object of the present invention is to provide a process for increasing the fusion temperature of a slag, particularly a high silica slag, derived from a combustible solid fuel (bark, wood chips), or the like, involving the addition of phosphated alumina to the slag or its precursors.

Another object of this invention is to provide slag whose fusion temperature has been increased and/or whose fouling tendencies have been decreased through the addition thereto, or to its slag forming materials (or precursors), of a phosphated alumina.

Another object is to provide a technique for producing relatively high melting slags and/or low fouling slags by the process of adding phosphated alumina to slags and slag precursors thereby to reduce slagging problems and fouling deposit problems in and adjacent to a combustion zone.

Other and further objects, aims, purposes, features, advantages, improvements and the like will be apparent to those skilled in the art from the present invention.

DETAILED DESCRIPTION

The phosphated alumina which is employable in the practice of the present invention can be in any convenient or desired form.

Examples of suitable forms include:

(A) mixtures of a phosphoric acid or phosphorous pentoxide with an aluminum hydroxide and/or alumina hydrate (preferably trihydrate) wherein the mole ratio of aluminum to phosphate ranges from about 1:1 to 1:3;

(B) reaction products of a phosphoric acid or phosphorous pentoxide with an aluminum hydroxide or alumina hydrate (preferably trihydrate) wherein the combined mole ratio of aluminum to phosphate ranges from about 1 to 4 (and wherein the reaction products are mainly preferably aluminum phosphates); and (C) aluminum phosphates of such formulas as:

$AlPO_4$ (e.g. aluminum phosphate)

(Al) $(H_2PO_4)_3$ (e.g. aluminum dihydrogen phosphate)

$(Al)_2$ $(HPO_4)_3$ (e.g. aluminum monohydrogen phosphate)

and their hydrates, and (D) mixtures thereof.

The phosphated alumina initially can be in a particulate solid form, or it can be in the form of a solution or slurry in a carrier liquid, such as water (water being presently preferred). Any convenient method of phosphated alumina preparation may be employed, if desired.

Thus, a phosphated alumina can either be a compound or mixture of compounds composed of phosphate ($PO_4$) and aluminum (Al) or a composition of compounds comprised of phosphates and aluminum which under the influence of elevated temperatures react with one another to produce a compound or mixture of compounds comprised of phosphate and aluminum and mixtures thereof. In a phosphated aluminum, the mole ratio of aluminum to phosphate typically ranges from about 1 to 3 though lower and higher ratios can be employed wihout departing from the spirit and scope of this invention. Excess quantities of non-aluminum containing phosphates and non-phosphate containing aluminum compounds can be present with a phosphated alumina. Suitable elevated temperatures can range from about 150° to 250° F. though higher and lower temperatures can be involved or utilized, depending on conditions.

Preferably, the phosphated alumina is at the time of admixing in the physical form of an aqueous liquid (e.g. a solution, suspension, etc.). More preferably, such is in the form of an aqueous solution containing at least one phosphated alumina reaction product which has been produced by reacting under aqueous liquid phase conditions a phosphoric acid with an alumina trihydrate. Such a product can contain from about 10 to 60 weight percent of said reaction product and most preferably such an aqueous solution contains additionally dissolved therein from about 1 to 10 weight percent (based upon the total weight of said aqueous solution of boric acid).

A presently preferred phosphated alumina which is employed in the practice of the present invention is prepared by reacting phosphoric acid with aluminum hydroxide under aqueous liquid phase conditions. For example, an aqueous solution of phosphoric acid in water is conveniently heated to a temperature ranging from about 110° to 150° F. and finely divided particulate aluminum hydroxide is added to so-heated phosphoric acid solution with stirring to provide a slurry. Preferably, the mole ratio of charged aluminum hydroxide to phosphoric acid ranges from about 1:1 to 1:4.

Then, while mixing continues, a small amount of boric acid (preferably from about 1 to 5 weight percent total quantity of phosphoric acid and aluminum hydroxide present, or equivalent) is slowly added to the system and the system temperature is raised preferably to a temperature of at least about 200° F. and more preferably to one not about 250° F. Auxiliary heating may be necessary to produce temperatures in this range.

During the temperature rise, the mixture system is continuously mixed, or agitated, and after the desired upper temperature desired is reached, mixing and heating are continued for a period of time typically ranging from about 15 to 30 minutes, although longer and shorter times can be employed, if desired. Thereafter, the system is allowed to cool to room temperature to produce (at room temperature) a liquid preferably having the following characteristics:

(1) Viscosity at 74° F. about 220±20 centipoises (measured using a Brookfield viscometer equipped with a #2 spindle operating at 60 rpm).

(2) Specific gravity at 75° F. about 1.622±0.03 (measured with a hygrometer).

(3) Total acid content about 54±2 weight percent based upon 100 weight percent of total product weight measured as $H_3PO_4$).

As indicated above, the term "slag" is used herein in a generic sense to evaluate all solid combustion products of burned fuels; thus, the term includes slags, ashes, fouling deposits in the vicinity of a combustion zone, and the like. Phosphated alumina can be regarded as a slag modifier or additive in accord with the teachings of this invention. The invention is particularly effective with high silica slag or slag precursors; that is, slags and slag precursers having a silica ($SiO_2$) content greater than about 60 weight percent on a total slag weight basis.

Addition or admixture of phosphated alumina can be conveniently accomplished, if desired, particularly when the modifier is in a liquid form, by:

(1) addition to the fuel before it is burned, such as by spraying over fuel on the conveyor or stoker belt on which the solid fuel is moved into the combustion zone;

(2) injections directly into the combustion (burning) zone, such as at the secondary air inlet of a furnace; and/or (3) injection into the fuel gas taken from a combustion zone just before deposition on solid surfaces typically occurs.

Treatment dosages are preferably calculated depending on the estimated amount of slag in a fuel being combusted. Preliminary testing to determine total slag of a given fuel (as an approximation of total inorganic material content) is preferred as those skilled in the art appreciate. Since many of the inorganic components of a given fuel are removed from the combustion zone in a solid and gaseous form, slags from a given fuel typically represent only a minor proportion of the total initially present inorganic components of a given fuel.

In one presently preferred mode, this invention is practiced when burning bark and/or wood wastes which have high silica slags. In, for example, a bark fired boiler, the slag contains mostly calcium compounds, and silica (up to 81% as the result of sand pick-up during transportation), and phosphated alumina is found to be a most effective additive which is able to increase the fusion temperature of slag from bark combustion. The treated slag deposits become dry, porous, and friable, and are easier to remove by conventional soot blowing techniques compared to untreated bark slag. Thus, in a boiler whose heat transfer surfaces have previously been fouled by deposits from bark combustion, followed by soot blowing to clean fouled surfaces, it is found that by addition of phosphated alumina to the bark before or during combustion, or to the flue gas stream from the fire box, slower deposit build up takes place than formerly and such deposits are easier to remove in subsequent soot blowing, thereby improving furnace operating and maintenance economics.

Generally, there are three types of furnaces employed for the burning of hogged wood, wood wastes and barks: Pile, thin bed, and fluidized bed incineration.

In pile burning, a Dutch oven or an extension type of furnace equipped with a flat grate is the earliest known design for burning wood refuse in a pile. Wood and/or bark hogged fuel is gravity fed through an opening in the fire box roof, forming a conical pile of fuel on the grate. Combustion air enters through the bottom grate, blows around the edge of the pile, and sweeps over the fuel, so that most of burning continuously takes place on the surfaces of the pile.

In thin bed burning, a boiler fueled by wood or bark utilizes a traveling grate of the spreader stoker type which is similar to that used for coal firing. Wood is introduced above the grate into the furnace either by a pneumatic or a mechanical spreader system. Typical capacity ranges from about 25,00 to 500,000 lb/hr of steam. Thin bed burning is commonly utilized in newer steam plants.

In fluidized bed incineration, a heated bed of sand in constant motion (i.e. fluidized) is used to burn wood wastes. As the combustion air exhausts from the nozzles and rises through such a granular bed, the heated sand and wood particles mixture become suspended by the rising air and behaves much like a fluid. Before any of the wood particles can be ignited and burned, all the free water and most of the bound water initially associated therewith must be driven off as steam. Thereafter, the temperature of particles rises rapidly and the combustible volatiles escape therefrom and burn either in the fluidized bed or in vapor phase above the bed. The residual char particles burn more slowly than the volatile materials and ordinarily such particles burn substantially completely in the fluidized bed. In these three furnace types, phosphated alumina can be admixed with fuel, slag and/or mixtures thereof in any manner chosen.

EMBODIMENTS

The present invention is further illustrated by reference to the following examples. Those skilled in the art will appreciate that other and further embodiments are obvious and within the spirit and scope of this invention from the teachings of these present examples taken with the accompanying specification.

Starting materials

Example A

A stainless steel reactor vessel is charged with a commercial grade of phosphoric acid containing (on a 100 weight percent total basis) about 75 weight percent $H_3PO_4$ plus about 25 weight percent of water. To this is added sufficient additional water to bring the total concentration of $H_3PO_4$ in the resulting solution to about 57.75 weight percent. The reactor vessel is then heated to 135° F. and sufficient alumina trihydrate ($Al_2O_3.3H_2O$, or also expressed as $Al(OH)_3$) is slowly admixed with the phosphoric acid solution to produce a molar ratio of alumina trihydrate to phosphoric acid ($H_3PO_4$) in admixture of about 1:8. The alumina trihydrate used is available commercially from Alcoa Company under the trade designation "Hydrol 710." An exothermic reaction between the alumina trihydrate and $H_3PO_4$ occurs.

After the alumina trihydrate addition is completed, about 5 weight percent (based upon total mixture weight) of boric acid is slowly added while stirring is continued and the indicated temperature is maintained. The boric acid is believed to stabilize the final phosphated alumina product which may otherwise possibly become cloudy and/or even develop a precipitate.

The temperature of the reactants is then allowed to rise to about 200° F. Auxiliary heating is sometimes necessary to attain this temperature. Mixing is continued as the temperature rises and after this temperature is achieved until all solid additives are substantially completely dissolved and a substantially homogeneous, uniform, clear liquid reaction system is obtained. Typically, at least, about 15 minutes is required for this state to be achieved, although longer and shorter times may be observed. The composition of the product, after cooling to room temperature, is found to be as follows:

1. Viscosity at 70° F. about 220 (using a Brookfield viscometer with a #2 spindle at 60 rpm).
2. Specific gravity at 75° F. about 1.6222 (measured with a hygrometer).
3. Total acid about 54 weight percent (measured on a 100 wt % total product basis) measured as $H_3PO_4$ The product is comprised of water plus probably dissolved $Al(H_2PO_4)_3$, unreacted, dissolved $H_3PO_4$, and dissolved boric acid. The phosphated alumina content of this product is about 45.6 weight percent (on total product weight basis).

In place of the starting 75% $H_2PO_4$ (commercial grade) one can employ 85% $H_3PO_4$ (commercial grade) and add sufficient water to produce an $H_3PO_4$ concentration as indicated.

In place of "Hydrol 710", one can employ other grades of alumina trihydrate (hydrated alumina) from Alcoa Company or Kaiser Chemicals, such as those grades available commercially from Aluminum Company of America as C-30, C-3, C-33, C-37 and the like.

Example B

A dry blend of finely divided alumina trihydrate (about 21.5 weight percent, "Hydrol 710") and finely divided phosphorous pentoxide (about 78.5 weight percent) is prepared.

Example C

A slurry blend of 85 weight percent phosphoric acid aqueous solution and alumina trihydrate in the respective mole ratio of about 1:8 is prepared. The alumina trihydrate is available commercially as "Alumina hydrate C-330" from Alcoa Company.

Example D

A finely divided aluminum phosphate the mixture of commercially available aluminum dihydrogen phosphate from Alfa Products, Thiokol/Ventron Division and aluminum phosphate from Pfaltz & Bauer Inc. Div. of Aceto Chem. Co. As used herein, the term "finely divided" without stated qualification has reference to particle sizes under about 20 microns.

Example E

A sample of slag taken from a furnace wherein bark is combusted is obtained and analyzed and found to contain as major oxide components (on a 100 weight percent total slag basis):

| Oxide Component | Weight percent |
|---|---|
| $SiO_2$ | 81 |
| CaO | 9 |
| $K_2O$ | 3 |

This slag additionally contains as minor components (that is, less than 2 weight percent each) the following oxides: $Al_2O_3$, MgO, $Fe_2O_3$, and $P_2O_5$.

Example F

A sample of slag taken from a furnace wherein hogged fuel is burned is obtained and analyzed and found to contain as major oxide components (on a 100 weight percent total slag basis):

| Oxide component | Weight percent |
|---|---|
| $SO_3$ | 33 |
| CaO | 27 |
| $K_2O$ | 17 |
| $SiO_2$ | 10 |
| MgO | 4 |
| $Al_2O_3$ | 3 |
| $Fe_2O_3$ | 2 |

This slag additionally contains as minor components (that is less than 2 weight percent each) the following oxides:

$P_2O_5$, $Na_2O$ and $MnO_2$

Hogged fuel comprises bark, shavings, sawdust and low grade lumber rejects resulting from the operation of pulp, saw and plywood mills.

PRACTICE OF THE INVENTION

Examples 1–4

Softening temperature (ST) and fluid temperature (FT) for slag samples are determined by the procedure specified in ASTM test no D-1857-68. By this procedure, "softening temperature" is taken to be considered as fusion temperature in the United States, and such fusion temperature (so determined by such ASTM procedure) provides the basis, it is understood, for specifying the fusion temperature of slag produced from coal combustion as coal is sold for steam generation in the United States.

A sample of each slag being tested herein is ground to an extent sufficient for the resulting powder to pass a 100 mesh U.S. Standard Sieve after which a measured quantity thereof is mixed with a phosphated alumina product of Example A which is preliminarily diluted with 40 to 60 weight percent of additional water (total diluted solution weight basis). The amount of diluted solution used is such as to produce a paste containing about 5 weight percent of phosphated alumina in slag. This paste is then formed into cones as specified in the afore indicated ASTM procedure after which the cones are dried in an oven maintained at about 225° F. for about 1 hour.

Thereafter, the cones are evaluated according to the aforeindicated ASTM test procedure to determine softening temperature and fluid temperature. "Softening temperature" (or "fusion temperature", as explained above) is defined as "the temperature at which the cone has fused down to a spherical lump in which the height is equal to the width at the base . . . ," while "fluid temperature" is defined as "the temperature at which the fused mass has spread out in a nearly flat layer with a maximum height of 1/16 in (1.6 mm) . . . " ("Standard Test Method for Fusibility of Coal and Coke Ash", ASTM D1857-68 (Reapproved 1974) p. 263). The results are shown in Table I below:

TABLE I

| Ex. No. | Slag Sample Tested | ST (°F.) | FT (°F.) |
|---|---|---|---|
| 1 | Example E Untreated Control | 2620 | over 2700 |
| 2 | Example E with 5% ExA | 2750 | Under 2800 |
| 3 | Example F Untreated Control | 2340 | 2370 |
| 4 | Example F with 5% ExA | 2240 | 2300 |

These results indicate that a phosphated alumina is more effective with a high silica containing slag than with a medium silica slag.

Examples 5–8

The procedure of Examples 1–4 is repeated except that in place of the phosphated alumina of Example A there is dry blended with the 100 mesh slag 5 L weight percent of the phosphated alumina blend of Example B and tamped cones are made from the resulting treated mixture without addition of water thereto. The product cones are sufficiently rigid to permit further following of the procedure of ASTM test no D-1857-68. The results indicate that the treated slag has a higher softening (fusion) temperature than the untreated slag, but the extent of fusion temperature raising is greater with the slag of Example E than with the slag of Example F (relative to respective untreated controls).

Examples 9–12

The procedure of Examples 1–4 is repeated except that in place of the phosphated alumina of Example A there is employed the slurry of Example C in an amount sufficient to admix 5 weight percent (100 weight percent total mixture basis) of such phosphated alumina with each of the starting slags.

Results of tests under ASTM procedure no. D-1857-68 indicate that the treated slag has a higher softening (fusion) temperature than the untreated slag, but the extent of fusion temperature raising is greater with the slag of Example E than with the slag of Example F (relative to respective untreated controls).

Examples 13–16

The procedure of Examples 1–4 is repeated except that in place of the phosphated alumina of Example A there is employed the phosphated alumina of Example D in an amount sufficient to admix 5 weight percent (100 weight percent total mixture bases) of such phosphated alumina with each of the starting slags.

Results of tests under ASTM procedure no. D-1857-68 indicate that the treated slag has a higher softening (fusion) temperature than the untreated slag, but the extent of fusion temperature raising is greater with the slag of Example E than with the slag of Example F (relative to respective untreated controls).

Examples 17–20

The procedure of Examples 1–4 is repeated except that the quantity of phosphated alumina of Example A employed is reduced to 0.5 weight percent based upon the total mixture weight of slag therewith.

Results of tests under such ASTM procedure indicate that the treated slag has a higher softening (fusion) temperature than the untreated slag, but the extent of fusion temperature raising is greater with the slag of Example E than with the slag of Example F (relative to respective untreated controls).

In each of the preceding Examples, the test results are submitted to be completely representative of conditions which would prevail in an actual commercial scale furnace where (a) the fuel is admixed with phosphated alumina, (b) the slag is admixed with a phosphated alumina, (c) the combustion zone reactants are admixed with a phosphated alumina, or (d) some combination of the above is practiced.

Example 21

A thin bed burning boiler fueled by bark and utilizing a traveling grate of the spreader stoker type is provided with an injection nozzle (and associated delivery pipes) in the neck of the duct leading to the boiler tubes but adjacent the fire box, and, when the furnace boiler is in full, normal operation, there is injected by spraying into the heated off gas exhaust stream a liquid like that of Example A at a rate equal to about 0.025 to 0.10 weight percent of the fuel (bark, wasted wood) being used by the combustion in progress in the fire box.

Previously, the boiler tubes had been thoroughly cleaned by conventional steam or air sootblowing, and previously, operating experience with this boiler and with this fuel had established the rate of build up of fouling deposits on the boiler tube surfaces.

It is found that the rate of fouling deposit build up is substantially reduced by the injection described so that the time between necessary steam soot blowing is substantially extended thereby reducing boiler maintenance requirements and improving boiler operating efficiency. Also, deposits from such a build up by so treated slag are easier to remove in subsequent soot blowing operations.

We claim:

1. A process for increasing the fusion temperature of slag resulting from the combustion of a solid fuel, said slag having a silica content in excess of about 60 weight percent on a total 100 weight percent slag basis comprising admixing with a material selected from the group consisting of said slag and precursers of said slag at least one composition from the class consisting of phosphated aluminas.

2. The process of claim 1 wherein said admixing is carried out at the rate of from about 0.1 to 5 weight percent based upon the total amount of inorganic matter present in said material.

3. The process of claim 1 wherein said phosphated alumina is at the time of said admixing in the form of an aqueous liquid.

4. The process of claim 3 wherein said aqueous liquid is in the form of a solution containing at least one phosphated alumina reaction product which has been produced by reacting under aqueous liquid phase conditions a phosphoric acid with an alumina trihydrate.

5. The process of claim 3 wherein the quantity of said reaction product present in said solution ranges from about 10 to 60 weight percent based upon the total weight of said aqueous solution.

6. The process of claim 4 wherein said aqueous solution additionally contains dissolved therein from about 1 to 10 weight percent dissolved boric acid based upon 100 weight percent of said solution.

7. The process of claim 1 wherein said phosphated alumina is at the time of said admixing in the form of a finely divided solid.

8. The process of claim 1 wherein said admixing is carried out at the rate of from about 0.1 to 1 weight percent based on the total amount of inorganic matter present in said material.

9. The process of claim 1 wherein said admixing is carried out directly with said slag itself.

10. The process of claim 1 wherein said admixing is carried out with a solid fuel which when combusted will result in the production of said slag.

11. The process of claim 1 wherein said admixing is carried out in a combustion zone as said slag is being produced by combusting a solid fuel.

12. The process of claim 1 wherein said phosphated alumina is selected from the group consisting of compounds of phosphate and aluminum compositions of compounds which at elevated temperatures react to produce compound(s) comprised of phosphate and aluminum, and mixtures thereof.

13. The process of claim 11 wherein said phosphated alumina is characterized by having a mole ratio of aluminum to phosphate in the range from about 1 to 4.

14. The process of claim 12 wherein said phosphated alumina is selected from the group consisting of (a) mixtures of at least one material selected from the group consisting of phosphoric acids and phosphorous pentoxide with at least one material selected from the group consisting of aluminum hydroxides and alumina hydrates wherein the mole ratio of aluminum to phosphate ranges from about 1:1 to 1:3, (b) reaction products of at least one material selected from the group consisting of phosphoric acids and phosphorous pentoxide with at least one material selected from the group consisting of aluminum hydroxides and alumina hydrates and wherein the combined mole ratio of aluminum to phosphate ranges from about 1 to 4, (c) aluminum phosphates selected from the group consisting of aluminum monohydrogen phosphate, aluminum dihydrogen phosphate, and aluminum phospate, and (d) mixtures thereof.

15. A process for decreasing the ratio at which deposits are formed on boiler tube surfaces in a boiler wherein a solid fuel is being combusted in a combustion zone to produce a slag characteristically containing in excess of about 60 weight percent silica on a 100 weight percent total slag solids basis comprising the step of injecting into the stream of combustion gases being removed from said combustion zone before any appreciable solids have separated from said stream from about 0.1 to 5 weight percent based upon the total amount of such slag being so produced at least one composition from the class consisting of phosphated aluminas.

16. The process of claim 15 wherein said phosphated alumina at the time of said admixing is in the form of an aqueous liquid.

17. The process of claim 15 wherein said aqueous liquid is in the form of a solution containing at least one phosphated alumina reaction product which has been produced by reacting under aqueous liquid phase conditions a phosphoric acid with an alumina trihydrate.

18. The process of claim 17 wherein said aqueous solution contains from about 10 to 60 weight percent of said reaction product on a 100 weight percent total solution basis.

19. The process of claim 18 wherein said aqueous solution additionally contains from about 1 to 10 weight percent of dissolved boric acid on a 100 weight percent total solution basis.

20. A modified slag composition having an elevated fusion temperature and a reduced tendency to form deposits on surfaces of heated boiler tubes comprising on a 100 weight percent total inorganic matter basis:

(a) from about 0.1 to 5 weight percent of phosphated alumina, and (b) the balance up to 100 weight percent being a material selected from the group consisting of slag and precursers of said slag, said slag having a silica content in excess of about 60 weight percent on a total 100 weight percent slag basis.

21. The composition of claim 20 wherein said weight percent of said phosphated alumina ranges from about 0.1 to 1.0.

22. The composition of claim 20 wherein said phosphated alumina is selected from the group consisting of:

(a) mixture of at least one material selected from the group consisting of phosphoric acids and phosphorous pentoxide with at least one material selected from the group consisting of aluminum hydroxides and alumina hydrates wherein the mole ratio of aluminum to phosphate ranges from about 1:1 to 1:3, (b) reaction products of at least one material selected from the group consisting of phosphoric acids and phosphorous pentoxide with at least one material selected from the group consisting of aluminum hydroxides and alumina hydrates and wherein the combined mole ratio of aluminum to phosphate ranges from about 1 to 4, (c) aluminum phosphates selected from the group consisting of aluminum monohydrogen phosphate, aluminum dihydrogen phosphate, and aluminum phosphate, and (d) mixtures thereof.

23. The composition of claim 20 which is prepared by admixing said phosphated alumina and said material together in a combustion zone as said slag is being produced by combusting a solid fuel in a combustion zone.

24. The composition of claim 23 wherein said phosphated alumina is characterized by having a mole ratio of aluminum to phosphate in the range from about 1 to 4.

25. The composition of claim 20 which is prepared by injecting said phosphated alumina into a stream of combustion gases being removed from a combustion zone before any appreciable solids have a separated from said stream, said combustion gases having been produced from combusting in said combustion zone a solid fuel to produce a slag containing in excess of about 60 weight percent silica on a 100 weight percent total slag solids basis.

* * * * *